US006684769B2

(12) United States Patent
Hed

(10) Patent No.: US 6,684,769 B2
(45) Date of Patent: Feb. 3, 2004

(54) SHEET CLEANER IN A MULTI-STATION PRINTING MACHINE

(75) Inventor: Bryan Hed, Waconia, MN (US)

(73) Assignee: Best Buy Enterprise Services, Inc., Richfield, MN (US)

( * ) Notice: Subject to any disclaimer, the term of this patent is extended or adjusted under 35 U.S.C. 154(b) by 96 days.

(21) Appl. No.: 10/113,508

(22) Filed: Apr. 1, 2002

(65) Prior Publication Data

US 2003/0183104 A1 Oct. 2, 2003

(51) Int. Cl.[7] ..... B41F 15/00; B41F 15/12

(52) U.S. Cl. ..... 101/129; 101/115; 101/123; 101/425; 101/483; 15/256.5

(58) Field of Search ..... 101/425, 126, 101/123, 129, 115, 483; 15/256.5, 104.002

(56) References Cited

U.S. PATENT DOCUMENTS 3,877,371 A * 4/1975 Jaffa ..... 101/425
4,982,469 A * 1/1991 Nishiwaki ..... 15/3
5,165,339 A 11/1992 Hoffman et al.
5,553,536 A * 9/1996 Van Os ..... 101/44
6,158,343 A 12/2000 Hoffman, Jr. et al.
6,568,326 B1 * 5/2003 Corrado et al. ..... 101/483

OTHER PUBLICATIONS

Polymag Tek Inc. Manufacturing & Technology; Are Contaminated Products Costing you Money?; Internet p. 1.

* cited by examiner

*Primary Examiner*—Andrew H. Hirshfeld
*Assistant Examiner*—Leo T. Hinze
(74) *Attorney, Agent, or Firm*—Beck & Tysver, P.L.L.C.

(57) ABSTRACT

In a rotary screen printing apparatus, a method and apparatus are disclosed for converting a printing station into a cleaning station. A cleaning attachment replaces either the squeegee or the flood bar, or both, in a conventional print station.

7 Claims, 6 Drawing Sheets

SHEET CLEANER IN A MULTI-STATION PRINTING MACHINE

FIELD OF THE INVENTION

The present invention relates generally to a sheet cleaner for removing dust and debris from a substrate prior to printing on the substrate and more particularly to the conversion of a printing station into a cleaning station, in a multi-station printing apparatus.

BACKGROUND OF THE INVENTION

In a screen printing process, ink is selectively applied to a surface or substrate. Dust or debris residing on the printing surface interferes with the application of the ink; areas of the surface under dust or debris will remain ink-free, yielding flaws in the resulting printed image. Dust and debris are generated particularly prolifically where substrates must be cut to size prior to the printing operation. Most particularly, dust and debris are created when a foam-core substrate is used and is cut prior to printing; this material yields dust which clings persistently to the printing surface due to static electricity. The problem of dusty substrates presents particular problems where volumes of printed sheets must be printed on relative quick turn-around. Stopping the printing apparatus to dust sheets by hand, or having to print extra sheets to replace flawed sheets, interferes with efficient printing.

A rotary screen printing apparatus provides a number of printing stations. At each printing station, one color of ink is applied. By passing the printing substrate through successive stations to receive ink of differing colors, multi-color printed matter is generated. For some print jobs, not all of the ink stations that are provided with the rotary screen printing apparatus are required. In such cases, one or more printing stations may be superfluous.

U.S. Pat. No. 6,158,343 describes the incorporation of a sheet cleaner in a rotary printing apparatus. This sheet cleaner is positioned adjacent to one of the printing stations. The sheet cleaner is a rolling cylindrical member. As a platen on which a sheet rests is rotated past the cleaner, the cleaner rolls across the printing surface in a direction generally perpendicular to the direction of movement of the ink applicator bar. This sheet cleaner does not take advantage of any of the precise mechanisms that control the path and pressure of the ink applicator bar. Further, this arrangement results in the cleaning of surface areas of the platen that extend beyond the sheet to be printed. This unnecessary cleaning causes the cleaning member to get unnecessarily dirty, requiring that it be cleaned or replaced relatively frequently.

SUMMARY OF THE INVENTION

The present invention provides a cleaning attachment for converting a printing station into a cleaning station. The invention further relates to a method for converting a printing station into a cleaning station by replacing either or both of the squeegee or flood bar with a cleaning attachment.

An object of the present invention is to use extra printing station capacity in a screen printing apparatus as a sheet cleaning station.

Another object of the present invention is to selectively convert a screen printing station into a sheet cleaning station with relatively minor modifications to the printing station.

Still another object of the present invention is to use existing printing mechanisms to manipulate the sheet cleaner to facilitate effective sheet cleaning.

Yet another object of the present invention is to use a tacky roller to collect dust and debris from a printing substrate.

Still another object of the present invention is to provide a sheet cleaning device which collects dust from the sheet to be printed without unnecessarily cleaning the surrounding platen surface.

Another object of the present invention is to provide a sheet cleaning device which is easily adjusted to use appropriate pressure to clean the sheet, regardless of the thickness of the sheet or substrate to be cleaned.

Still another object of the present invention is to provide a sheet cleaning device that operates simultaneously with printing being carried out at other printing stations, such that sheet cleaning does not delay printing operations.

Yet another object of the present invention is to provide a retrofit cleaning assembly for use on a rotary screen printing apparatus.

Another object of the present invention is to provide a cleaning assembly that allows for convenient cleaning of the cleaner.

Still another object of the present invention is to provide a cleaning assembly that can easily replace printing tools on a screen printing apparatus to convert a printing station into a cleaning station, and for the conversion to be easily reversible, such that when necessary for a given print job, all print stations can be employed for printing, but when not necessary, one station can be used for cleaning.

Another object of the present invention is to provide a simple, easy-to-use, low-cost, flexible and speedy apparatus and method to clean a sheet prior to printing.

BRIEF DESCRIPTION OF THE DRAWINGS

An exemplary version of a sheet cleaning apparatus in use in conjunction with a rotary screen printing apparatus is shown in the figures wherein like reference numerals refer to equivalent structure throughout, and wherein.

DETAILED DESCRIPTION OF PREFERRED EMBODIMENT(S)

Figure 1:
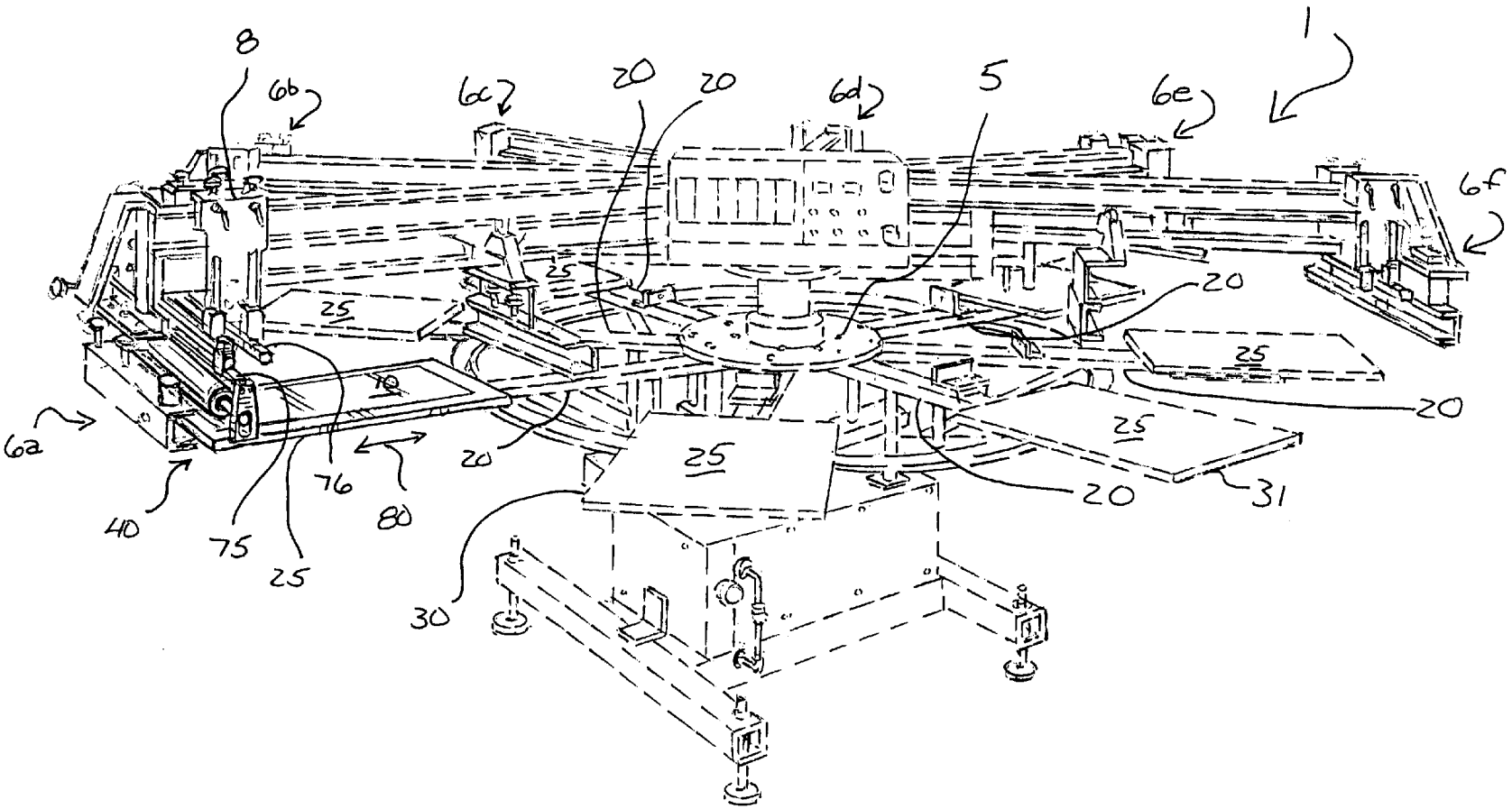
FIG. 1 is a perspective view of a rotary screen printing apparatus having one cleaning station according to the present invention.

A rotary screen printing apparatus or machine 1 that incorporates the present invention is illustrated in FIG. 1. The screen printer 1 includes, generally, a hub 5. The screen printer 1 has multiple printing stations 6 located in a generally circular pattern, each spaced circumferentially from adjacent stations, about the hub 5. Each printing station 6 includes a flood bar (not shown) which supplies ink during printing. The flood bar is connected to mechanisms 8 for moving the flood bar across a sheet 10 during printing, for controlling the stroke, or length of movement in the direction indicated by arrow 80, of the flood bar, and for raising and lowering the floor bar in relation to the sheet 10 position. Each printing station 6 also includes a squeegee 15 which, after ink has been applied by the flood bar, pushes ink through a screen and removes excess ink during printing. The squeegee 15 is connected to mechanisms 8 for moving the squeegee 15 across the sheet 10 during printing, for controlling the stroke, or length of movement in the direction of arrow 80, of the squeegee 15 and for raising and lowering the squeegee 15 in relation to the sheet 10 position.

Neither the flood bars nor the squeegees 15 are illustrated on the print stations 6 shown in FIG. 1, but will be known to those of skill in the art. The manner in which they attach to mechanisms 8 and can be removed will be apparent from description below.

Arms 20 extend radially from the hub 5 and are attached to the hub for rotational movement about the hub 5. Attached to each arm 20 is a platen 25 which, during printing, supports a sheet of paper or other substrate material 10 for printing thereon. The platens 25 are positioned generally the same distance from the hub as the printing stations 6. During operation, the platens are selectively positioned in registration with the print stations 6. More specifically, a platen 25 with a sheet 10 positioned thereon is rotated into registration with a first designated print station 6. At that first print station 6, one ink color is applied by a flood bar and squeegee 15 according to typical screen printing technique. Platen 25 is then rotated to a next printing station 6 where another color is applied. This rotating and printing continues until the platen 25 has visited each printing station 6.

A screen printer 1 may include additional stations, such as drying stations (not shown) between adjacent print stations. In addition, a screen printer 1 may include a set-up station 30 where an operator places a sheet on a platen, and an end station 31 from which an operator removes a printed sheet after the sheet has visited all of the printing stations. Typically, the set-up and end stations 30, 31 are adjacent one another.

As illustrated in FIG. 1, print station 6a has been converted into a cleaning station 40 where the sheet 10 to be printed upon is cleaned, brushed or dusted to remove dust and debris before moving to a printing station 6*b* where the first printing will actually occur. Thus, print station 6a does not have a squeegee 15 or flood bar; instead, the squeegee 15 has been replaced with a cleaning attachment 50. In an alternate embodiment, the flood bar can be replaced with a cleaning attachment 50. In yet another embodiment, both the squeegee 15 and the flood bar can be replaced with cleaning attachments 50.

Figure 2:
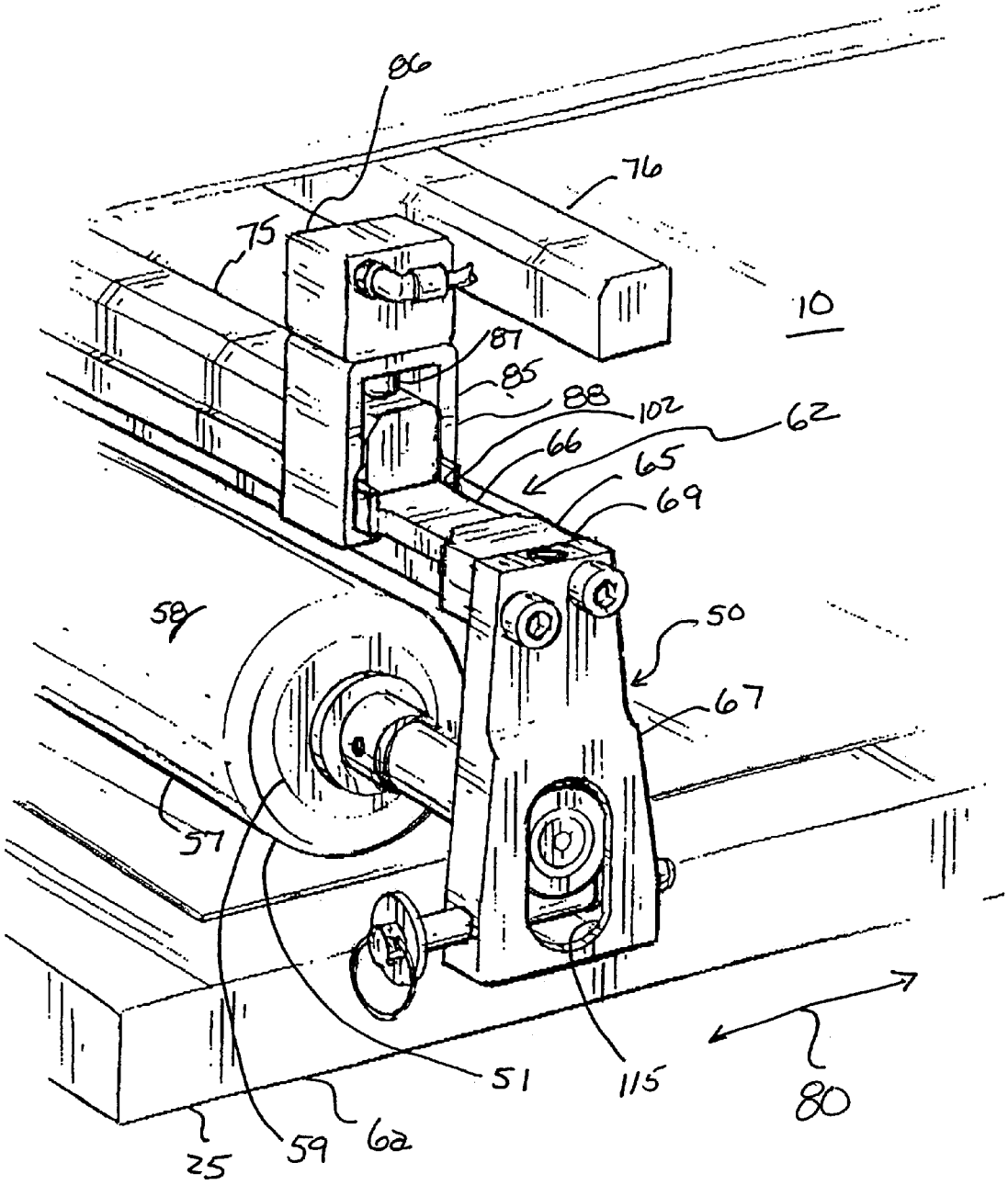
FIG. 2 is a partial perspective view of a cleaning attachment according to the present invention mounted on a printing station like that illustrated in FIG. 1.
Figure 3:
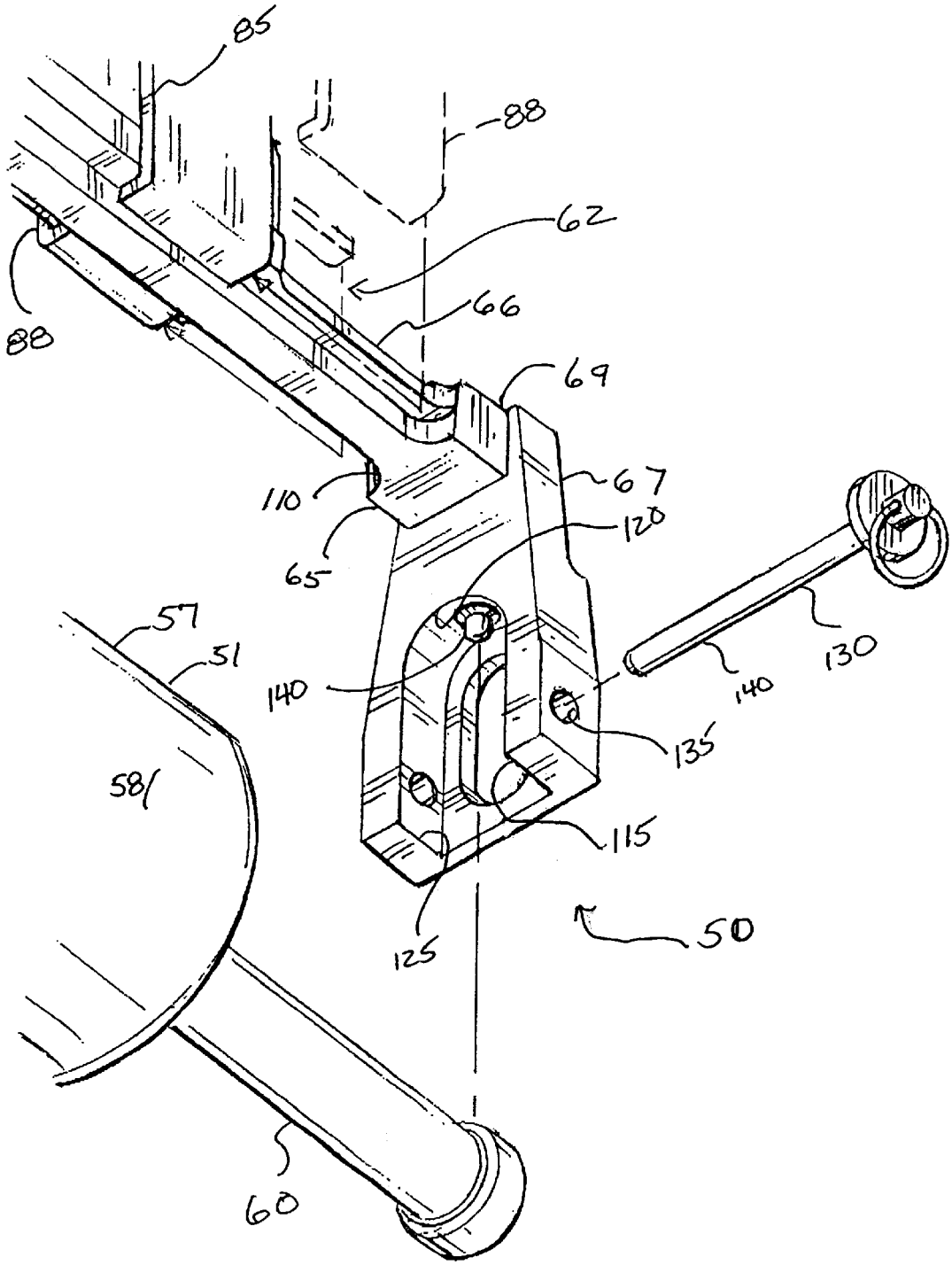
FIG. 3 is an exploded partial perspective view of the cleaning attachment illustrated in FIG. 2.
Figure 4:
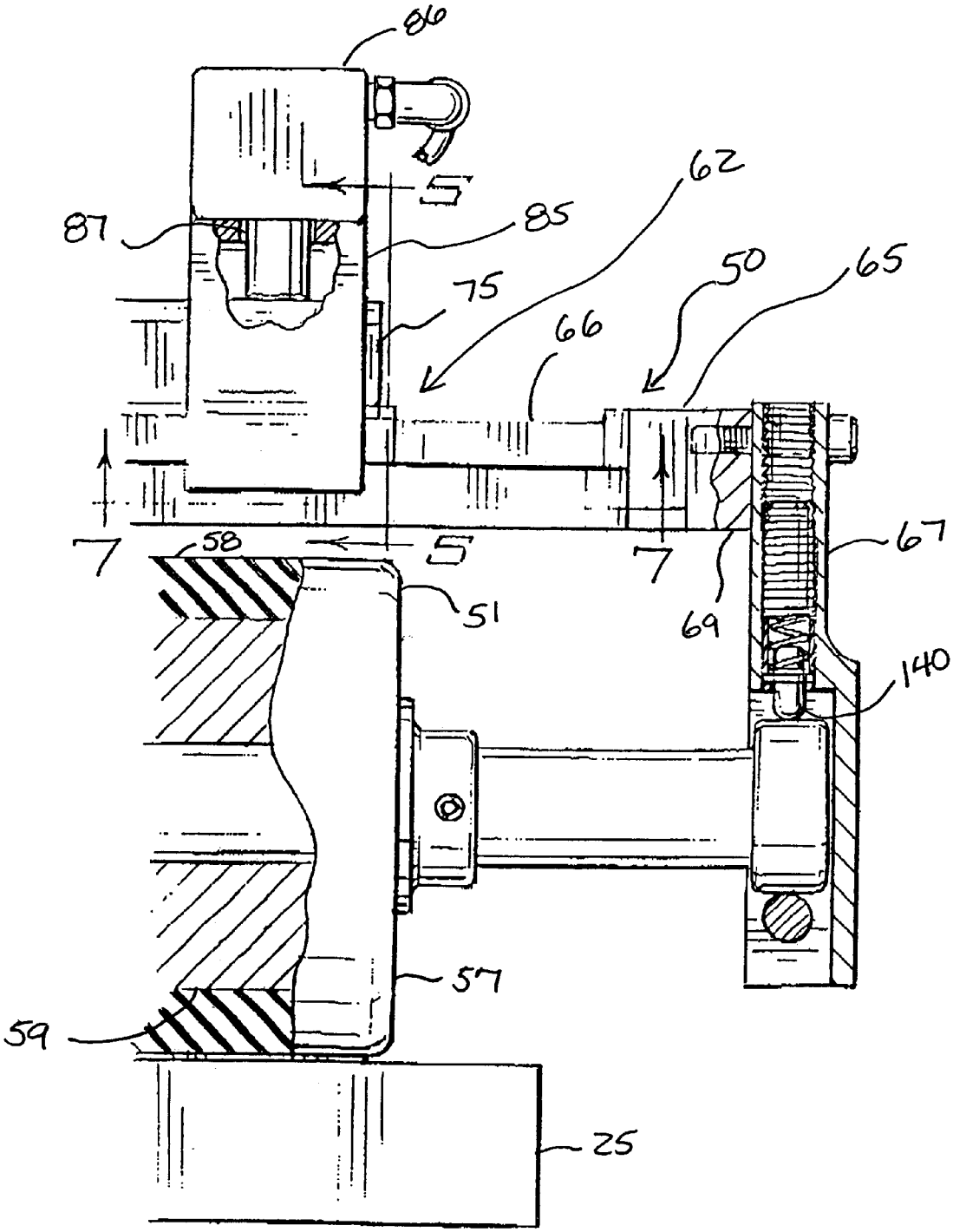
FIG. 4 is a plan view of the cleaning attachment of FIG. 2 mounted on a printing machine like that shown in FIG. 1, with portions illustrated in cross-section.

The cleaning attachment 50 is illustrated in FIGS. 2–4 and 8. The cleaning attachment 50 has a cleaner 51 mounted in a generally U-shaped bracket 65 which is adapted to coordinate with mating structure on a printing station 6, as will be described below. The cleaner 51 illustrated in the FIGURES is a cylindrical roller 57 having a tacky surface 58. An example of a commercially available material that has been found to work effectively for this task is Polymag® Super Tack sold by Polymag Tek, Inc. of Rochester, N.Y. (www.polymagtek.com). The tacky surface 58 surrounds a core 59 which is shown in FIG. 4. Other materials can be used for the cleaning roller. Polymagtek's Polymag® Blue Contact Cleaning rolls, for example, can be used. This roll is somewhat less tacky or sticky than the Super Tack roller noted above and therefore does not pick up dust and debris quite as completely as the Super Tac roller.

Other types of cleaners 51 are contemplated, including brushes, feathers or the like.

The roller 58 is mounted on a shaft 60 which is received by and attached to the bracket 65. In the embodiment illustrated, the shaft 60 does not extend continuously through the roller 57, but rather is in two pieces, which extend axially outward from the roller 57. Alternatively, the shaft 60 could be one continuous member.

A mounting assembly 62 selectively and removably mounts the cleaning attachment 50 (or the squeegee 15 or the flood bar) to the printing machine 1. Those of skill in the mechanical arts will appreciate that many configurations of mounting assemblies would function satisfactorily. Nevertheless, many typical printing machines use a clamp-based mounting assembly 62 like that illustrated in the FIGURES. Generally, the printing station 1 bears a first mating portion of the assembly 62 and the squeegee or flood bar or cleaning attachment bear another mating portion. One or more clamps 85 are used to clamp the mating portions together, or in other words to clamp a component (squeegee 15, flood bar or cleaning attachment 50) to the printing machine 1. In the embodiment illustrated, the mating portion of the mounting assembly 62 on the printing machine 1 is generally a support bar 75 or 76, and the mating portion of the mounting assembly 62 on the cleaning attachment 50 is generally the mounting bracket 65. Clamps 85 secure the mating portions to one another.

Figure 6:
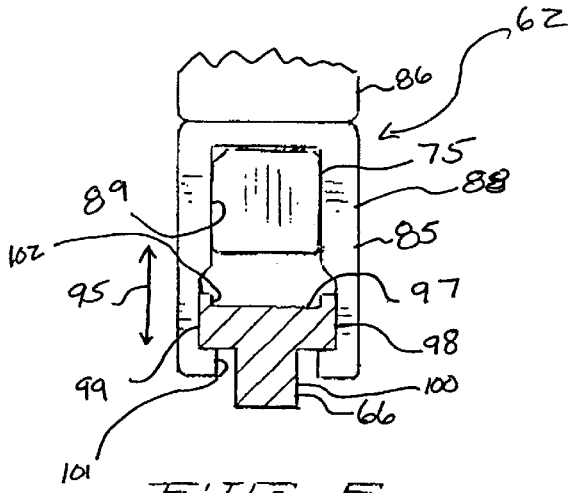
FIG. 6 is a is an end plan view, taken along line 5 is FIG. 4, that illustrates the clamp of FIG. 5 in an open or un-clamped position for selectively decoupling a squeegee, flood bar or cleaning attachment from the printing machine, according to the present invention.
Figure 7:
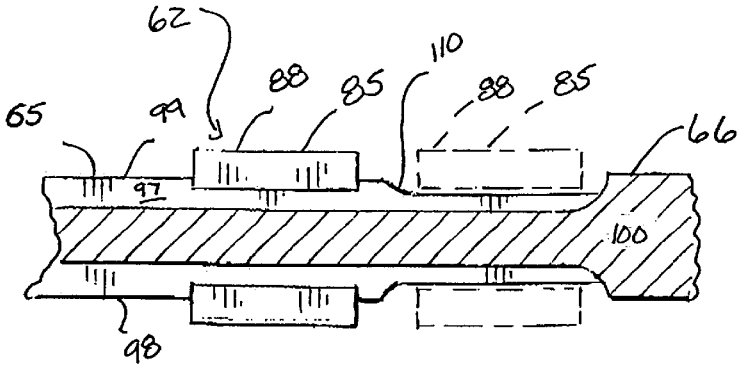
FIG. 7 is a bottom view, taken along line 7 in FIG. 4, of a portion of the mounting assembly of a cleaning attachment according to the present invention mounted to the printing machine of FIG. 1.
Figure 8:
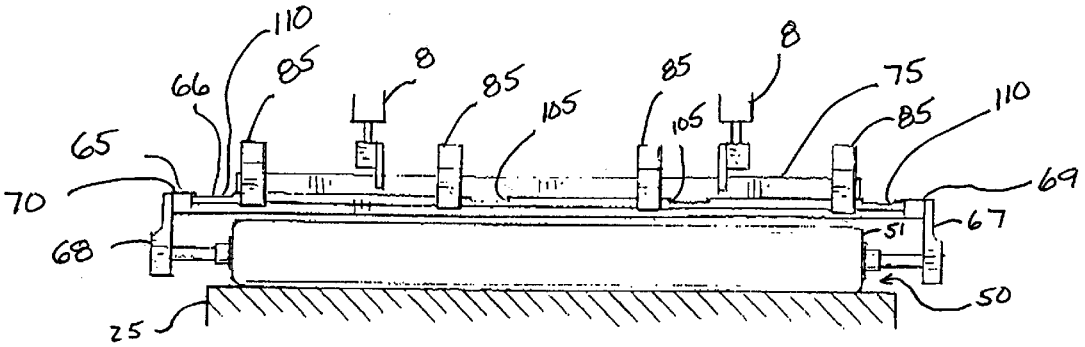
FIG. 8 is an elevational view of a cleaning attachment mounted on a printing machine in place of a squeegee, according to the present invention.

Portions of the U-shaped mounting bracket 65 are apparent in FIGS. 2–7; the length of the bracket 65 is shown in full, but with somewhat reduced detail, in FIG. 8. As apparent from FIG. 8, the bracket 65 has an elongate center beam section 66 extending between the legs of the U-shape which, in the illustrated embodiment are end plates 67, 68 adjacent opposite ends 69, 70 of the center beam section 66. The end plates 67, 68 engage the shaft 60 which supports the roller 57. The center beam section 66 is configured, as will be described with greater detail with respect to FIGS. 2–3, to couple to a support bar 75 on the printing machine 1.

Each station 6 includes two such support bars 75 and 76 like those shown in FIG. 2 which, in a typical printing machine, support the squeegee 15 and the flood bar, respectively. The bars 75 and 76 are generally parallel to one another and extend perpendicular to the radial direction indicated by arrow 80. In a typical printing station 6, one bar 75 supports the squeegee 15 and the other bar 76 supports the flood bar. When a printing station 6 is converted into a cleaning station 40 in accord with the present invention, one or both bars 75, 76 support a cleaning attachment 50. Each support bar 75, 76 is coupled to mechanism 8 which moves the bars 75 and 76 and their attached squeegee, flood bar or cleaning attachment, in the radial direction indicated by arrow 80 across a sheet 10 on the platen 25. In addition, the mechanism 8 moves the bars up and down to move the attached squeegee, flood bar or cleaning attachment into and out of operational positions.

A squeegee 15, flood bar or cleaning attachment 50 is removably attached to bars 75, 76 via clamps 85 as can be understood with reference to FIGS. 2–8. As indicated in FIG. 8, the illustrated embodiment includes four clamps 85, though any number of clamps may be used that securely perform the clamping function. Clamps 85 are used in traditional screen printing machines to allow squeegees and flood bars to be easily removed for cleaning, repair or replacement. Other arrangements for connecting a squeegee/flood bar/cleaning attachment may be employed within the spirit of this invention. For example, if a user wished to permanently transform a printing station into a cleaning station, the cleaning attachment might replace a printing tool (squeegee or flood bar) and then be permanently or semi-permanently attached to the printing station, such as by welding or using fasteners that are more difficult to remove than the quick-release clamps described herein. Nevertheless, advantages are achieved by using the structure provided with the printing machine 1 to selectively and reversibly change a printing station 6 to a cleaning station 40.

Figure 5:
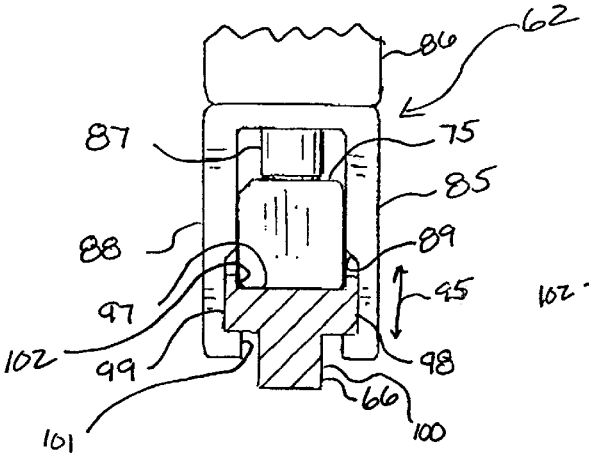
FIG. 5 is an end plan view, taken along line 5 is FIG. 4, that illustrates a clamp in a clamped position for attaching a cleaning attachment according to the present invention.

As illustrated in FIGS. 5–7, clamp 85 receives and squeezes together a support bar 75 or 76 and a mating portion of the selected item. The clamp 85 has a generally C-shaped housing 88 defining a channel 89 therein for receiving components to be clamped together. The channel 89 must be long or tall enough in the direction indicated by arrow 95 to accommodate the size in the direction of arrow 95 of the two components to be clamped together. The terminating edges of the C-shaped housing 88 form an internal seat 90. This seat 90 supports one of the components to be clamped together; in other words, the seat 90 forms a surface against which the components can be pressed to clamp them together.

The clamp 85 has generally two positions: a clamped or closed position illustrated in FIG. 5 and an open or unclamped position illustrated in FIG. 6. A pneumatic valve 86 effectuates changes between the two positions. The valve 86 controls the movement of a piston 87 in a linear direction (vertical, in the orientation shown). When the clamp 85 is closed, the piston 87 extends into the channel 89. Thus, one of the components abuts the piston 87 on one side and the other component on the other. The other component, as noted above, abuts the seat 90 of the clamp 85. When the clamp 85 is opened, the piston 87 withdraws away from the channel 89. With the piston 87 is withdrawn, there is extra room or play in the direction of arrow 95 which allows the components to slide longitudinally within the clamp 85.

In FIGS. 5–7, the "selected item" is a cleaning attachment 50, but it will be understood by those of skill in the art, that these clamps 85 engage a squeegee 15 and a flood bar in a similar manner. As described above, the mounting bracket 65 of the cleaning attachment 50 includes a center beam section 66. This beam has a generally T-shaped cross section along at least a portion of its length. This shape is apparent in FIGS. 5 and 6. When engaged by clamp 85, the cross-bar 97 of the T resides within the channel 89 and at least its terminated ends or edges 98, 99 rest upon or abut the seat 90 of the clamp 85. The vertical bar 100 of the T extends through the opening 101 defined by the terminating edges of the C-shaped clamp 85. The top of the cross-bar 97 includes a recess or channel 102 which is sized to receive the support bar 75 for secure clamping of the two components (the support bar 75 and the cleaning attachment's mounting bracket 65) together.

Thus clamped, the cleaning attachment 51 is connected to mechanism 8 by virtue of being clamped to a support bar 75 or 76 which is attached to mechanism 8, as illustrated in FIG. 8. The mechanism 8 which controls the position and movement of the squeegee 15 and the flood bar to perform printing operations is engaged to similarly control the position and movement of the cleaning attachment 50. In this manner, the relatively sophisticated abilities of the mechanism 8 can be usurped for optimal control of the cleaning operation. For example, the length of the stroke of the cleaning attachment 50 can be adjusted to closely match the length, in the radial direction 80, of the sheet 10 to be cleaned. The width of the area (i.e. in the direction transverse to the radial direction 80) to be cleaned is equal to the length of the roller 57. For a given print job, a roller having a length that approximately matches the width of the sheet 10 to be cleaned can be selected. The user might have on hand a number of rollers 57 of varying widths to accommodate the sizes of sheets 10 typically printed by the user. Thus the area cleaned by the sheet cleaner 51 is equal to the length of the selected roller 57 multiplied by the selected stroke length for the path of travel of the cleaning attachment 50 in the direction indicated by arrow 80. Advantages are achieved by approximately matching the cleaning area with the size of the sheet itself. The cleaning attachment 50, such as a contact roller 57, needs to be cleaned periodically to remove the dust it has collected. By limiting the area it is cleaning to approximately just the area of the sheet 10, the amount of dust collected is minimized. As a result, the frequency with which the cleaning attachment 50 must be cleaned is reduced without sacrificing effectiveness of the cleaning, and this efficiency aids quick and efficient printing operations.

Figure 9A:
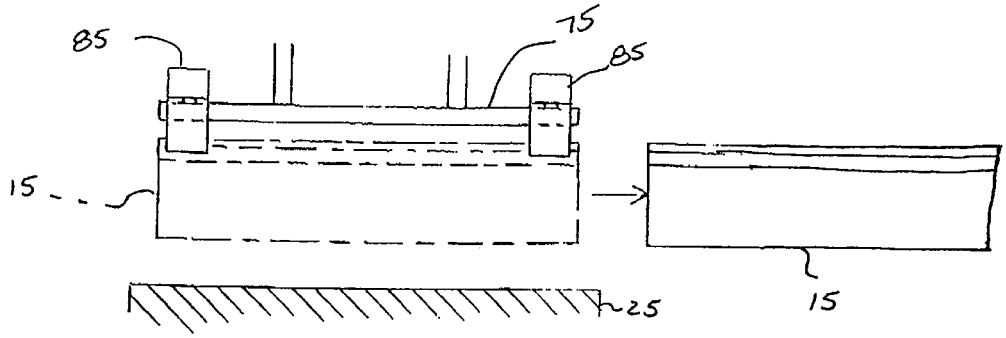
FIGS. 9*a*–9*c* diagrammatically illustrate the steps in removing a squeegee from a printing machine and replacing the squeegee with a cleaning attachment, according to a method of the present invention.
Figure 9B:
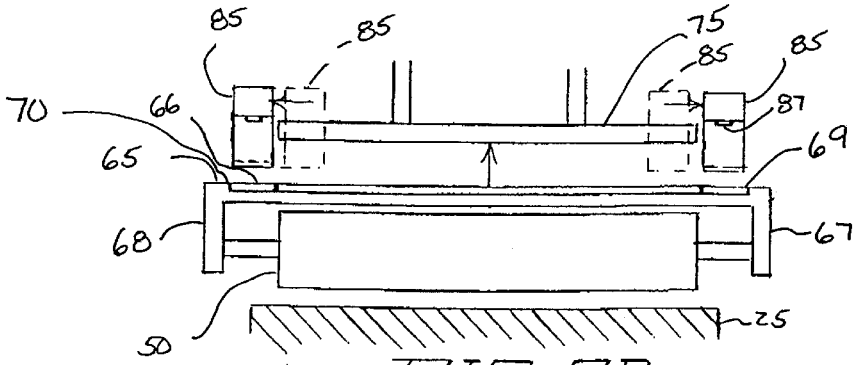
Figure 9C:
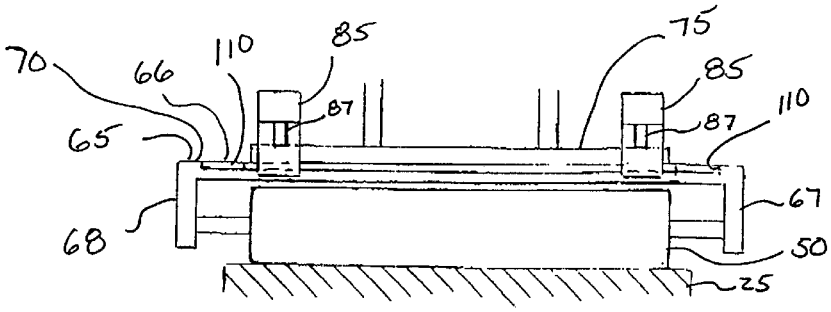

The process for converting a printing station 6 into a cleaning station 40 is illustrated diagrammatically in FIG. 9. Only the two outermost clamps 85 of the embodiment of FIG. 8 are illustrated for simplicity. As noted above, the number of clamps 85 is generally immaterial, and can be selected based on the size of the printing apparatus 1 and other factors, including the strength of the clamps 85 to achieve effective, secure attachment of the cleaning attachment 50 to the printing station 6. FIG. 9*a* illustrates the removal of a squeegee 15, by placing clamps 85 into the open or unclamped position, and sliding the squeegee 15 out of contact with support bar 75. As illustrated in FIG. 9*b* and 9*c*, the cleaning attachment or assembly 50 is positioned generally adjacent the clamps 85 and support bar 75, and is then lifted and slid so that center beam 66 enters channel 89. As illustrated in FIG. 9*c*, clamps 85 are placed into a closed position, thereby clamping the cleaning attachment 50 to the support bar 75. The cleaning attachment 50 of the embodiment illustrated uses a slightly different directional manipulation to engage clamps 85 than the squeegee 15 does because the end plates 67, 68, in the illustrated embodiment, are not sized to slide within channel 89. It is contemplated, however, that at least one of the end plates 67, 68 could be sized and shaped to allow at least one end plate 67, 68 to slide into and through a clamp 85, or that other aspects of the mounting bracket 65 could be altered, so that the cleaning attachment 50 might be mounted via simple horizontal sliding motion like the squeegee 15.

In the embodiment illustrated in the FIGURES, the central beam 66 of the mounting bracket 65 includes notches or recesses 105 in the cross-bar 97. These recesses 105 are visible in FIG. 8 and allow the center beam 66 to clear the terminating ends of the C-shaped clamps 85 to pass through clamp opening or slot 101. Thus, to mount the cleaning attachment 50 to the support bar 75, the center beam 66 of mounting bracket 65 is positioned with notches 105 adjacent a clamp 85; the cleaning attachment 50 is lifted such that the clamps 85 pass through the notches 105, and then the cleaning attachment 50 is moved sideways or longitudinally, such that the clamp seat 90 engages or supports an un-notched portion of the center beam 66.

Because of structural components in the embodiment of the printing machine 1 that are not illustrated, the two external clamps 85 of the four total clamps 85 operate with slight differences than the manner just described. The outer two clamps 85 are completely removed from the support bar 75 to allow the cleaning attachment 50 to be installed. The clamps 85 are removed by simply sliding them off the end of the support bar 75. The clamps are replaced after the cleaning attachment 50 is supported by the center clamps 85, by positioning the clamp 85 adjacent notch 110 in center beam 66, and then sliding the clamp 85 transversely into engagement with an un-notched portion of the center beam 66, as illustrated in FIG. 3.

In other versions of the printing machine 1 wherein such structural limitations are not present, all clamps, whatever their number, might engage the center beam 66 using notches 105, 110 and simultaneous transverse displacement. Further, as noted above, with modifications to the ends of the mounting bracket 65, the cleaning attachment 50 might slide into clamps 85 as the squeegee 15 does.

FIGS. 2 and 3 illustrate one embodiment for removably mounting the cleaner 51 in the mounting bracket 65. The bracket 65 includes recesses 115 for engaging opposite ends of the shaft 60. The recess 115 has a closed upper end 120 and an opposite open end 125. A key member 130 is used to close open end 125 selectively. More specifically, each end plate 67, 68 defines a bore 135 for receiving the shaft 140 of the key member 130 therethrough or therein. In operation, the ends of shaft 60 slide into recess 115 via the open end 125. Key member 130 slides into bore 135 thereby closing end 120 and securing the shaft 60 within recess 115.

A spring-biased protrusion 140, as illustrated in FIGS. 2 and 3, protrudes into recess 115 and, in use, abuts the shaft 60. This allows the shaft 60 some vertical play in use to accommodate substrates 10 of various thickness.

Alternatively, the cleaning attachment 50 might be permanently attached or fixed to a mounting bracket 65, though advantages are achieved by mounting it in a removable manner such as the manner described and illustrated in FIGS. 2 and 3.

One method of cleaning a roller 58 is to place a tacky sheet or substrate on a platen in a cleaning station, and to pass the roller 58 over the tacky sheet. If the tacky sheet is stickier than the roller 58, the sheet will effectively clean the roller 58. Another method of cleaning the roller 58, particularly if a very tacky roller is used, is with soap and water or a 50/50 mixture of alcohol and water.

Although an illustrative version of the device is shown, it should be clear that many modifications to the device may be made without departing from the scope of the invention. For example, while the invention has been described in conjunction with a rotary screen printing apparatus, it might be incorporated into any multi-station printing apparatus.

What is claimed is:

1. A method for converting a printing station in a multi-station printing apparatus into a cleaning station, comprising the steps of:

a) providing a printing station;

b) providing a squeegee removably mounted to said printing station;

c) providing a cleaning attachment;

d) removing said squeegee; and e) connecting said cleaning attachment to said frame in place of said removed squeegee.

2. A method for converting a printing station according to claim 1, wherein said printing station and said squeegee bear mating portions of a mounting assembly, and wherein said cleaning attachment bears a portion of a mounting assembly adapted to mate with said mounting assembly portion on said printing station.

3. A method for converting a printing station according to claim 1, wherein said printing station includes a clamp defining a recess therein and wherein said cleaning attachment includes a clamp-engaging portion sized to be received within said recess and wherein said squeegee includes a clamp-engaging portion sized to be received within said recess.

4. A method for converting a printing station in a multi-station printing apparatus into a cleaning station, comprising the steps of:

a) providing a printing station;

b) providing a flood bar removably mounted to said printing station;

c) providing a cleaning attachment;

d) removing said flood bar; and e) connecting said cleaning attachment to said printing station in place of said removed flood bar.

5. A method for converting a printing station in a multi-station printing apparatus into a cleaning station according to claim 4, further comprising the steps of:

f) providing a squeegee removably connected to said printing station;

g) providing a second cleaning attachment;

h) removing said squeegee;

i) connecting the second said cleaning attachment to said printing station in place of said removed squeegee.

6. A method of cleaning a sheet in preparation for printing on a rotary printing apparatus having a hub with multiple printing stations extending in a radial direction therefrom, each said printing station including a squeegee, comprising the steps of:

a) converting a printing station into a cleaning station by replacing said squeegee with a cleaning attachment;

b) placing said sheet on said platen; and c) passing said cleaning attachment over said sheet on said platen in said radial direction.

7. A method of cleaning a sheet in preparation for printing according to claim 6, further comprising the steps of:

d) limiting the path of said cleaning attachment to the length, in said radial direction, of the sheet to be cleaned.

* * * * *